US005467874A

United States Patent [19]

Whitaker

[11] Patent Number: 5,467,874

[45] Date of Patent: Nov. 21, 1995

[54] BALL LOCK SOCKET HOLDER

[76] Inventor: Eugene Whitaker, 501 E. Spruce, Deming, N.M. 88030

[21] Appl. No.: 370,860

[22] Filed: Jan. 10, 1995

[51] Int. Cl.[6] ..... B65D 85/20

[52] U.S. Cl. ..... 206/378; 211/70.6; 248/309.2; 206/493

[58] Field of Search ..... 206/372, 373, 206/376, 377, 378, 493; 211/69, 70.6, 89; 248/309.2

[56] References Cited

U.S. PATENT DOCUMENTS

| | | | |
|---|---|---|---|
| 1,712,473 | 5/1929 | McWethy . | |
| 4,337,860 | 7/1982 | Carrigan . | |
| 4,621,738 | 11/1986 | DeLucchi | 206/378 X |
| 4,688,672 | 8/1987 | Pemberton . | |
| 4,927,020 | 5/1990 | Randy | 206/378 |
| 5,228,570 | 7/1993 | Robinson . | |
| 5,398,823 | 3/1995 | Anders | 206/378 X |

*Primary Examiner*—Jacob K. Ackun
*Attorney, Agent, or Firm*—Richard C. Litman

[57] ABSTRACT

A storage apparatus for tool sockets includes an elongated rack having affixed thereto a plurality of attachment mechanisms each provided with a guide channel and upstanding central cam element. A mounting member connected to each attachment mechanism includes a stub adapted to accommodate the square bore of a tool socket, with a transverse bore in the stub having a normally freely movable ball therein. Arcuate movement of the mounting member atop its attachment mechanism is limited by a tab on the mounting member disposed within the attachment mechanism guide channel. In an at rest condition, the tab is biased upwardly by a spring intermediate the attachment mechanism and mounting member. Upon the placement of a tool socket about a stub, the socket is depressed against the force of the spring to release the tab from an unlock recess and following rotary displacement of the socket and captive mounting member, the ball is urged by the cam element into a blocked position partially beyond the plane of the stub and into a detent as formed within the bore of the socket. Upon release of downward force upon the socket, the mounting member is biased upwardly with the tab entering a lock recess preventing unblocking of the ball from the socket without a deliberate two axis displacement of the mounting member.

10 Claims, 2 Drawing Sheets

BALL LOCK SOCKET HOLDER

FIELD OF THE INVENTION

This invention relates generally to tool holders and more particularly, to an improved rack or carrier device intended to releaseably support and retain socket tools of the type adapted to be used with attachable wrenches, typically referred to as socket or ratchet wrenches.

BACKGROUND OF THE INVENTION

Mechanics and other users of socket wrenches often maintain an inventory of well over 30 different sockets sized to accommodate nuts and bolts ranging from say ¼ inch upwards to 1¼" and more. Even by keeping these sockets in a designated tool box tray or tool chest drawer, much time is wasted while fumbling around to locate and select the next size socket needed. The problem is compounded when considering that to be able to service automotive vehicles and other equipment, one must now stock a full range of metric tools as well as US standard sizes. The frustration of locating just the size needed at any time is additionally perplexing since the majority of socket sizes must be maintained in each of two or three different drive sizes. That is, a ⅝ socket for example, is available in a ¼", ⅜" and ½" drive size and often the dictates of a particular mechanical configuration demands that only one wrench drive size will be appropriate. Accordingly, it will be appreciated that it would not at all be unusual for a professional mechanic to have available over 50 different sockets in their inventory.

For many years the best method of organization for a mechanic's tool sockets was to remember to return each socket after use to a designated spot in their tool tray, box or chest and anyone experienced in this area knows how long such intent lasts. Then, a few years ago, various holders or racks became popular, most all of which exhibited one shortcoming or another.

DESCRIPTION OF THE RELATED ART

Socket holder devices comprising a bar or the like and having a plurality of upstanding posts or stubs are generally well known. U.S. Pat. No. 1,712,473 issued May 7, 1929 to McWethy shows a socket holder with upstanding posts each provided with a transverse bore containing a pair of balls normally spring-urged outwardly. The illustrated sockets contain no detents but even if so equipped, it appears that the sole retention means comprises the biasing force of the balls upon opposite flats in the cavity of a mounted socket. This is contrary to the instant apparatus wherein a dual axis displacement of a mounted socket is required to position a socket and associated mounting member in an alternate position wherein a single normally freely movable ball is fixedly blocked in a locking position with an outer portion of the ball secured within a detent as formed within a socket.

U.S. Pat. Nos. 4,337,860 and 4,688,672 issued respectively to Carrigan and Pemberton on Jul. 6, 1982 and Aug. 25, 1987 depict other socket holding devices including a bar and upstanding post elements but are not seen to show any displaceable locking mechanism as advanced by this invention.

U.S. Pat. No. 5,228,570 issued Jul. 20, 1993 to Robinson illustrates a socket holder comprising a rack having a plurality of posts thereon, each including an axially displaceable, spring-urged element operable to fixedly urge a locking ball outwardly into a position serving to secure a socket thereto. However, no dual-axis displacement of a member is seen in this reference and which would preclude accidental dislodgement of a mounted socket were the rack dropped, as being proposed by the present invention.

None of the prior art known to applicant, whether considered singly or in any combination, is seen to even remotely suggest the novel improvement as presented by the instant invention.

SUMMARY OF THE INVENTION

By the present invention, an improved socket holder is advanced and which provides a positive means of attachment and retention of all socket tools while allowing of a simple maneuver to readily release the socket from the holder. Most importantly, the retention of the sockets in their orderly manner is assured even if the holder is dropped or otherwise disturbed. The foregoing is achieved through the use of a plurality of unique attachment mechanisms affixed to an elongated support or rack and each of which cooperates with an individual mounting member. These mounting members are both spring-urged and keyed relative to their respective attachment mechanisms to permit a limited arcuate displacement that respectively automatically locks and unlocks a socket thereupon. In this manner, it is only by the deliberate axial as well as arcuate displacement of the mounting member, that a socket may be locked to or unlocked from the holder of the improved holder. The ultimate anchorage of a socket to the present holder is accomplished by utilizing one of the detents as present within the square bore of all sockets and which are designed primarily to cooperate with the locking ball as provided on the mounting stub of socket or ratchet wrenches. A similar ball in the present mounting members provides a positive locking action in view of a cam element on the attachment mechanism that urges this ball into a socket detent upon the arcuate displacement aforedescribed. Accidental dislodgement of a socket from the instant holder is precluded as the present locking ball is not merely spring-urged into the socket detent but is rigidly forced there into by the fixed cam element.

Accordingly, one of the objects of the present invention is to provide an improved socket holder including a rack supporting a plurality of dual component elements, one fixed to the rack and the other arcuately displaceable relatively therewith upon the application of a dual axis movement, between socket unlocking and locking positions.

Another object of the present invention is to provide an improved socket holder including a stationary attachment member having a cam element fixed to a rack and supporting a surrounding mounting member having a freely movable ball alternately forced into a rigid position projecting from the mounting member by the cam element to retain a socket thereupon.

A further object of the present invention is to provide an improved socket holder including an attachment member secured to a rack and having a lateral slot therein with vertically offset recesses at opposite ends to receive a tab radially projecting from an axially spring-urged attachment member to provide a positive securing of the attachment member in both locked and unlocked positions.

Still another object of the present invention is to provide an improved socket holder including an arcuately displaceable mounting member supporting a radially movable ball and surrounding a fixed cam element with relative movement there between causing a blocking of the ball with its outer periphery disposed outside the mounting member to positively secure a socket surrounding same.

With these and other objects in view which will more readily appear as the nature of the invention is better understood, the invention consists in the novel construction, combination and assembly of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
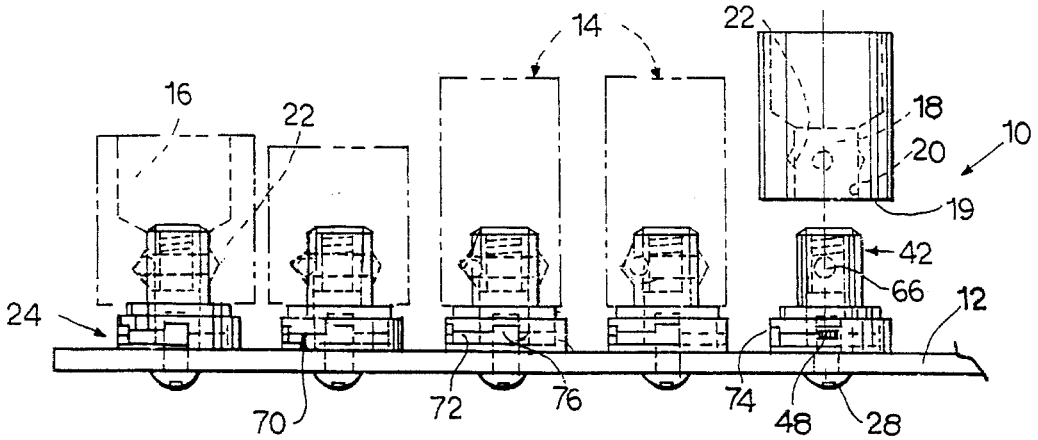
FIG. 1 is a fragmentary side elevation of a socket holder according to the present invention.

Referring now to the drawings, particularly FIG. 1, the present invention will be seen to comprise a socket holder, generally designated 10 and which includes an elongated support, base member or rack 12 which may define a length of any suitable length such as a foot or more. This length should be adaptable to fit within conventional tool box trays or tool chest drawers and typically each such socket holder 10 will be employed to accommodate a set of variously sized sockets 14, all part of a series, according to either drive size or socket length. The varied sizes between each socket of a set is a reference to the dimension of the nut or bolt head designed to be engaged by the cavity 16 of the sockets 14 as each socket of any one set of sockets will be understood to be provided with an identically dimensioned square bore 18 adjacent its opposite, tool or wrench receiving end 19. Accordingly, one set of sockets 14 may all include ¼ inch square bores while other sets comprise ⅜ and ½ inch bores, respectively. It should be understood that different socket set sizes may be utilized with any one rack 12 although this would normally defeat the objective of each rack being used to maintain an orderly retention of a "matched set" of sockets. The foregoing alternative is readily possible since the basic unique attachment and locking features of the present invention is not limited to restricting the sizes of sockets associated with any one rack 12.

As is well known to those skilled in the art of socket tools, each flat or interior wall 20 of a socket square bore 18 is provided with a dimple or detent 22, and which normally serves to receive a spring-urged ball carried by the drive stud (not shown) of a square drive ratchet wrench. As will be seen hereinafter, one of these very same detents 22 is employed by the present socket holder during its use.

Attached to the upper surface of the elongated rack 12 are a plurality of attachment mechanisms, generally designated 24 and which are longitudinally spaced apart from one another throughout the length of the rack. Any suitable device serves to affix the bottom 26 of each attachment mechanism 24 to the upper surface of the rack, such as the illustrated fastener 28. Each of these attachment mechanisms will be seen to comprise a cup-like member having an upstanding circular rim 30 connected to the bottom 28 and forming a concentric cavity 31 containing a central, vertical lower shaft 32 which terminates in an uppermost cam element 34 with an intermediate horizontal shoulder 36. The cam element 34 defines a smaller lateral extent than the attached lower shaft 32 and is provided with a circular or arcuate wall 38 joined to a flat 40. As will be seen most clearly in FIGS. 5 and 6 of the drawings, the arcuate wall 38 encompasses over ¾ of the extent of the cam element when viewed in top plan for reasons which will become apparent hereinafter.

Cooperating with each of the attachment mechanisms 24 is a mounting member 42 including a topmost square stub 44 attached to a circular base 46 having a tab 48 radially projecting from its circular wall 50 with a horizontal shoulder 52 defining the top surface of the base 46. Each of the four flat faces 54 of the stub 44 will be understood to define a horizontal dimension providing a close sliding fit within the square bore 18 of the socket intended to be attached thereto. Expressed alternatively, the stub 44 configuration will be comparable to that of the drive stud of a ratchet wrench adapted to be used with the particular socket in mind.

The interior of each mounting member 42 is provided with a lower, central, circular bore 56 bounded by a top shoulder 58 within the stub 44 and from which vertically extends a reduced diameter upper, central, circular bore 60. This bore 60 will be seen to terminate short of the stub top wall 62 while the medial portion of the bore 60 is intersected by a transverse, smaller diameter bore 64 communicating through at least one face 54 of the stub 44. A spherical locking ball 66 is freely disposed within the transverse bore 64 for normally unencumbered horizontal movement there within while the opening 68 through the stub face 54 is formed with a slightly reduced diameter to prevent the maximum diameter of the ball 66 from passing there through.

When assembled as in FIG. 1, the tab 48 of each mounting member 42 will be seen to be disposed within a guide channel 70 formed within the circular rim 30 of the respective attachment mechanisms. Each guide channel 70 includes a horizontal or lateral slot 72 circumferentially extending substantially 90 degrees or for one quadrant of the attachment mechanism rim 30 with each end of this slot 72 communicating with upwardly directed catch means comprising notches or recesses. At one end of the slot is a lock recess 74 while at the other end is an unlock recess 76.

Figure 2:
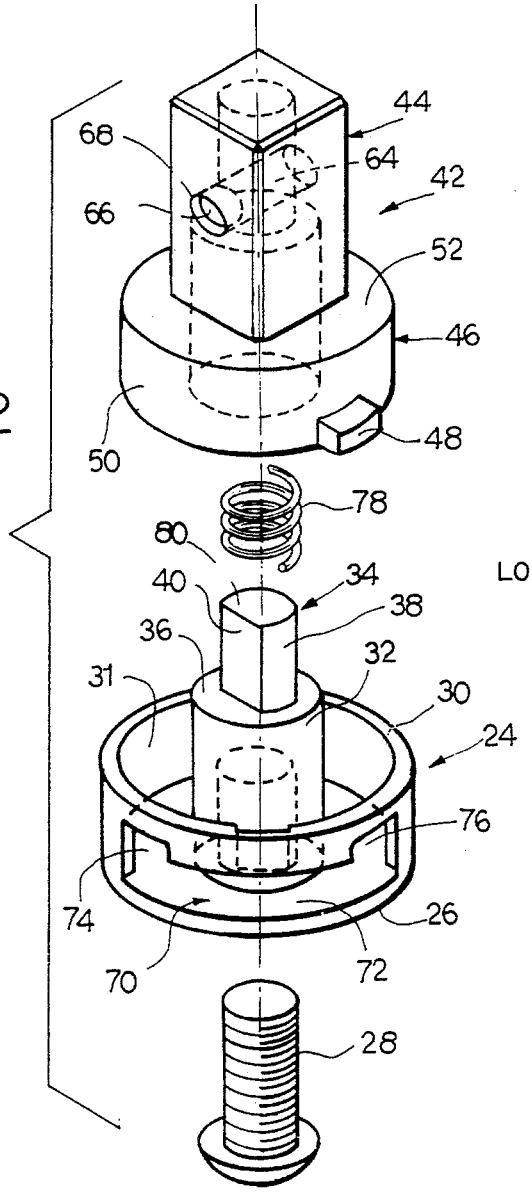
FIG. 2 is an exploded top perspective view illustrating the details of one of the attachment mechanisms and mounting members as used to accommodate each socket.
Figure 3:
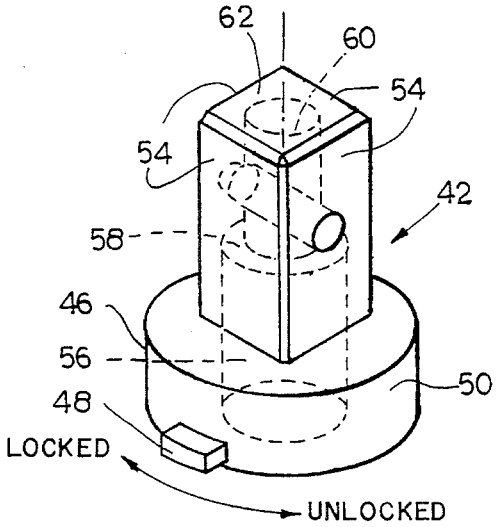
FIG. 3 is a perspective view of a mounting member, depicting its position alternate to that of FIG. 2.
Figure 4:
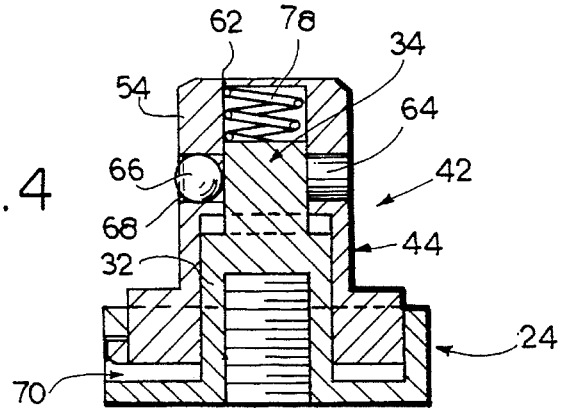
FIG. 4 is a vertical cross-sectional view of the assembly of the components of FIG. 2.

With reference to FIGS. 1 and 2 of the drawings, the relationship between the assembled socket holder components will become clear. A compression spring 78 will be seen to be disposed intermediate the top surface 80 of the attachment mechanism cam element 34 and the top wall 62 of the mounting member stub 44. In this manner, a constant upward force is applied to the mounting member 42 and its integral radial tab 48 with the result that whenever one of the mounting members is rotated or arcuately displaced to either limit of its movement, the tab 48 will be forced upwardly into a respective one of the recesses 74 or 76 and thus effectively secure the arcuate disposition of the mounting member 42 relative the associated attachment mechanism.

Figure 5:
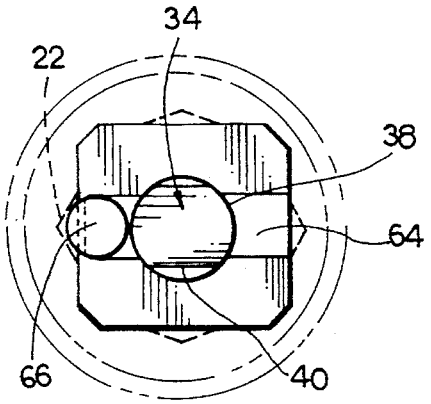
FIGS. 5 and 6 are top plan views reflecting the locked and unlocked positions, respectively, of the assembled attachment mechanism and mounting member.
Figure 6:
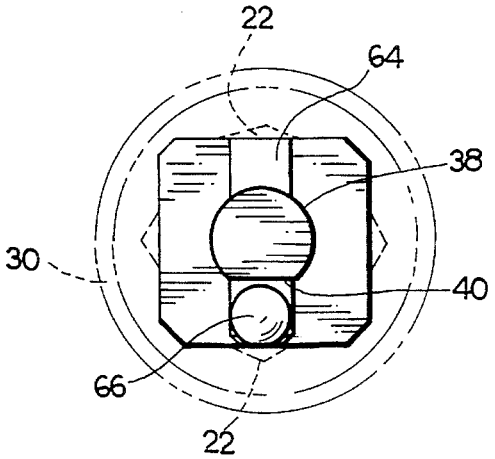

With the above construction in mind, the operation of the socket holder 10 may now be described. In the empty condition, the apparatus is ready to receive one or more sockets 14 when the respective mounting members 42 are positioned as depicted by the right hand assembly in FIG. 1 of the drawings and wherein the mounting member has been rotated counterclockwise until the tab 48 is spring-urged into the elevated position within the unlock recess 76 of the attachment mechanism 24. When thusly disposed, the relative position between the two principal components will be as shown in FIG. 6 of the drawings wherein the stub transverse bore 64 is axially aligned normal to the flat 40 on the stationary cam element 34 of the attachment mechanism 24. In this position, the dimensions of the transverse bore 64, ball 66, cam element 34 and bore 60 will be understood to insure that the ball 66 is free to be fully disposed within the confines of the transverse bore. As previously mentioned, the restrictive nature of the transverse bore opening 68 prevents the ball from fully exiting the bore 64 and thus when a socket is lowered about any one mounting stub 44 positioned as in FIG. 6, there will be no resistance to the lowering of a socket square bore 18 about the stub 44. Thereafter, with a socket resting upon the shoulder 52 of a mounting member 42, a user merely applies a positive downward pressure upon the mounted socket, against the force of the spring 78. This action downwardly displaces the mounting member 42 and moves the tab 48 to the horizontal plane of the lateral slot 72 after which the socket and the connected mounting member may be rotated 90 degrees. This latter movement to the opposite limit of the horizontal slot 72 causes the arcuate wall 38 of the cam element 34 to engage the locking ball 66 and urge its outer periphery to a fixed, radially extended position as shown in FIG. 5 and upon relaxation of the downward pressure upon the socket, the spring 78 elevates the mounting member 42 with the tab 48 entering the lock recess 74. In this locked position, it will be seen that the outer point of the fixedly positioned locking ball 66 will be disposed within the detent 22 of the attached socket 14 and thus the socket will be positively secured to the socket holder 10.

With the above construction, knocking over or even dropping the socket holder will not result in dislodgement of any sockets 14 mounted thereon since a deliberate two axis displacement against the force of the spring 78 is required before a socket may be removed from the assembly.

It is to be understood that the present invention is not limited to the sole embodiment described above, but encompasses any and all embodiments within the scope of the following claims.

I claim:

1. A holder for sockets having a wrench receiving end including a bore therein having an interior wall provided with a detent comprising;

an elongated support member including a plurality of spaced apart attachment mechanisms affixed thereto, a mounting member engaging each said attachment mechanism and having a lower base connected to an upper stub, said stub adapted to be engaged by the bore of a socket, a spring intermediate said mounting member and attachment mechanism and normally biasing said mounting member vertically away from said attachment mechanism, said stub provided with a transverse bore having a normally freely movable ball therein, a fixed cam element on said attachment mechanism disposed within said mounting member stub and intersecting said transverse bore, a guide channel in said attachment mechanism communicating with opposite catch means defining lock and unlock positions, and a tab on said mounting member disposed within said guide channel, whereby upon rotary displacement of said mounting member said tab is shifted between said opposite catch means to alternately cause said cam element to block said ball in a fixed position projecting from said stub to retain a socket by disposition of said ball within the socket detent and thence allow said ball to freely move away from the socket detent and the socket to be removed from the holder.

2. A holder for sockets according to claim 1 wherein, said attachment member includes a circular rim defining a cavity there within, and said mounting member lower base disposed within said attachment member cavity.

3. A holder for sockets according to claim 1 wherein, said guide channel includes a horizontal slot and said opposite catch means include vertically extending recesses communicating with said horizontal slot.

4. A holder for sockets according to claim 1 including, a lower shaft centrally disposed on said attachment mechanism, and said fixed cam element connected atop said lower shaft.

5. A holder for sockets according to claim 1 wherein, said mounting member includes a central bore, and said attachment mechanism fixed cam element disposed within said central bore

6. A holder for sockets according to claim 1 wherein, said stubs define a square configuration in plan view.

7. A holder for sockets according to claim 2 wherein, said tab radially projects from said mounting member lower base, and said guide channel and opposite catch means are disposed in said attachment member circular rim.

8. A holder for sockets according to claim 2 wherein, said guide channel includes a horizontal slot in said circular rim, and said horizontal slot describes an arc of substantially 90 degrees.

9. A holder for sockets according to claim 3 including, a bottom on said attachment mechanism juxtaposed said elongated support member, and said recesses communicating with said horizontal slot extend upwardly therefrom.

10. A holder for sockets according to claim 4 wherein, said cam element includes an arcuate wall describing an arc substantially greater than 270 degrees in plan view, and a flat on said cam element communicating with said arcuate wall.

* * * * *